US010801486B2

(12) United States Patent
Weatherley

(10) Patent No.: US 10,801,486 B2
(45) Date of Patent: Oct. 13, 2020

(54) FLUID PUMP COMPRISING A CONICAL BODY PRECESSED ABOUT ITS APEX BY A DRIVER CONNECTED BY A DRIVE SHAFT TO A BOSS ECCENTRICALLY CARRIED BY A DRIVE PLATE SUCH THAT A ROTATING PUMP CHAMBER IS FORMED BY A FLEXIBLE MEMBRANE ATTACHED TO THE CONICAL BODY

(71) Applicant: TCS Micropumps Limited, Kent (GB)

(72) Inventor: Richard Weatherley, Kent (GB)

(73) Assignee: TCS Micropumps Limited, Kent (GB)

( * ) Notice: Subject to any disclaimer, the term of this patent is extended or adjusted under 35 U.S.C. 154(b) by 44 days.

(21) Appl. No.: 15/319,218

(22) PCT Filed: Jun. 17, 2015

(86) PCT No.: PCT/EP2015/063657

§ 371 (c)(1),
(2) Date: Dec. 15, 2016

(87) PCT Pub. No.: WO2015/193407

PCT Pub. Date: Dec. 23, 2015

(65) Prior Publication Data

US 2017/0130710 A1 May 11, 2017

(30) Foreign Application Priority Data

Jun. 17, 2014 (GB) ..... 1410814.6

(51) Int. Cl.
*F04B 43/12* (2006.01)
*F04B 43/02* (2006.01)
(Continued)

(52) U.S. Cl.
CPC ..... *F04B 43/1207* (2013.01); *F04B 43/0009* (2013.01); *F04B 43/02* (2013.01); *F04B 43/14* (2013.01)

(58) Field of Classification Search
CPC .. F04B 43/1207; F04B 43/0009; F04B 43/02; F04B 43/14; F01B 19/02; F16H 23/00
(Continued)

(56) References Cited

U.S. PATENT DOCUMENTS 2,249,806 A * 7/1941 Bogoslowsky ..... F04B 43/0072 418/45
2,752,852 A * 7/1956 Offutt ..... F04B 43/14 417/474
(Continued)

FOREIGN PATENT DOCUMENTS

FR 862840 A 3/1941

OTHER PUBLICATIONS

Search Report and Written Opinion issued in International Application No. PCT/EP2015/063657, dated Dec. 17, 2015.

*Primary Examiner* — Devon C Kramer
*Assistant Examiner* — Benjamin Doyle
(74) *Attorney, Agent, or Firm* — Haugen Law Firm PLLP

(57) ABSTRACT

A fluid pump comprising a conical body having an apex, a base and defining a lateral surface between the apex and base; a mating surface defined by a pump plate; a flexible membrane having a first face comprising a first part which is attached to at least a portion of the lateral surface of the conical body and a second part which is free, and having a second, opposite face secured around its periphery to the mating surface; and a driver adapted to drive the conical body; wherein the mating surface includes a fluid inlet port and a fluid outlet port, the fluid inlet port being spaced from the fluid outlet port; the driver includes a drive shaft and a drive plate carried by the distal end of the drive shaft, wherein the drive plate is inclined with respect to a plane normal to a longitudinal axis of the drive shaft such that the drive plate drives the conical body to precess about its apex in use such that at any given time the flexible membrane defines a contact portion in contact with the mating surface where the lateral surface of the conical body is adjacent to the mating surface, and defines a non-contact portion which is spaced from the mating surface; a pump chamber is defined by a cavity formed between the non-contact portion
(Continued)

of the flexible membrane and the mating surface; the pump chamber rotates about an axis of the mating surface as the conical body precesses about its apex; and fluid is drawn into the pump chamber as it passes the fluid inlet port and the fluid is urged out of the pump chamber as it passes the fluid outlet port.

13 Claims, 1 Drawing Sheet

(51) Int. Cl.
*F04B 43/14* (2006.01)
*F04B 43/00* (2006.01)

(58) Field of Classification Search
USPC ..... 92/103 R, 103 F; 74/60; 417/474; 418/45, 107, 50
See application file for complete search history.

(56) References Cited

U.S. PATENT DOCUMENTS 2,915,983 A * 12/1959 Berrian ..... F04B 43/1207 418/45
3,019,964 A * 2/1962 Griswold ..... F04C 21/005 418/53
3,058,428 A * 10/1962 Gemeinhardt ..... F04B 1/146 418/107
3,669,578 A * 6/1972 Nameny ..... F04B 43/14 418/45
3,922,119 A * 11/1975 Rosenquist ..... F04B 43/0054 418/45
4,483,666 A * 11/1984 Schubert ..... F04B 43/1207 418/45
4,486,151 A * 12/1984 Korhonen-Wesala ..... F04B 43/02 417/222.1
5,178,515 A * 1/1993 Tsuchiya ..... F04D 11/00 415/206
5,458,469 A * 10/1995 Hauser ..... F04B 43/1207 417/474
5,466,133 A * 11/1995 Tuck, Jr. ..... F04B 43/0054 417/474
5,529,468 A * 6/1996 Tuck, Jr. ..... F04B 43/0054 417/474
5,533,886 A * 7/1996 Von Der Heyde ..... F04B 43/1207 417/413.1
6,065,567 A * 5/2000 Camacho ..... F01M 11/0458 141/98
8,662,870 B2 * 3/2014 Dalziel ..... F04C 27/001 418/51
8,784,079 B2 * 7/2014 Becker ..... A61M 5/1413 417/476
2014/0044580 A1 * 2/2014 Balbo Di Vinadio .... F01C 3/06 418/51

* cited by examiner

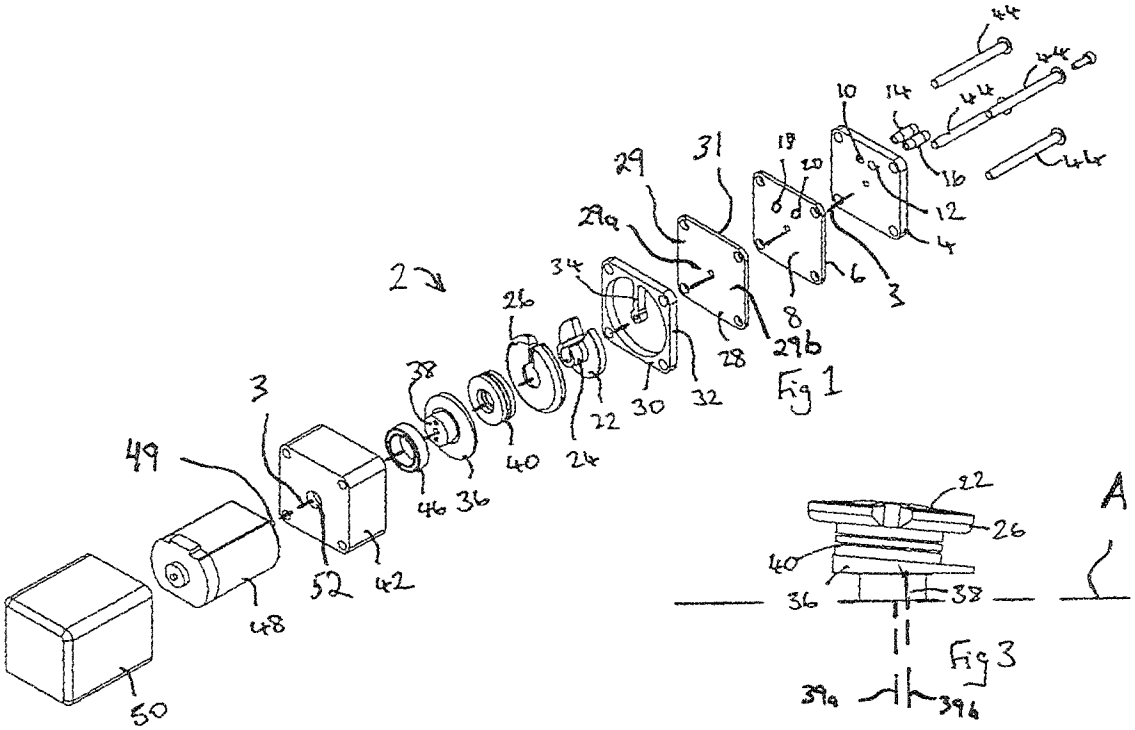
Fig 1
Fig 3
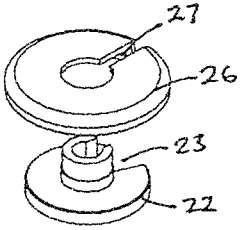
Fig 2

FLUID PUMP COMPRISING A CONICAL BODY PRECESSED ABOUT ITS APEX BY A DRIVER CONNECTED BY A DRIVE SHAFT TO A BOSS ECCENTRICALLY CARRIED BY A DRIVE PLATE SUCH THAT A ROTATING PUMP CHAMBER IS FORMED BY A FLEXIBLE MEMBRANE ATTACHED TO THE CONICAL BODY

The present invention relates to a fluid pump and in particular to a pump that operates via a conical drive element.

Fluid pumps are well known and operate using different principles, such as a peristaltic pump or a piston pump, for example. However, the known pumps often have drawbacks, such as noise, ability to self-prime, the pumping force or pressure that the pump is able to generate and so on. A further disadvantage of known pumps is the need for one-way valves to control the flow of fluid into and from the pump. Such one-way valves can get easily clogged if the fluid to be pumped is contaminated or viscous. In addition, they add to the overall cost of the pump.

Pumps based upon the concept of a precessing or rotating cone are known from U.S. Pat. No. 3,058,428 and DE 1528971. However, in U.S. Pat. No. 3,058,428, the conical element includes a shaft which is mounted at an angle within a carrier disc. Such an arrangement places lateral stresses on the drive shaft of the motor and consequently significantly shortens the life span of the motor. DE 1528971 on the other hand relies upon the elastic nature of the membrane to draw in fluid, as the membrane is not attached to the conical member.

It is therefore desirable to provide a new pump which addresses at least of the known drawbacks with existing fluid pumps.

According to a first aspect of the invention, there is provided a fluid pump comprising a conical body having an apex, a base and defining a lateral surface between the apex and base; a mating surface defined by a pump plate; a flexible membrane having a first face comprising a first part which is physically attached to at least a portion of the lateral surface of the conical body and a second part which is free, and having a second, opposite face secured around its periphery to the mating surface; and a driver adapted to drive the conical body; wherein the mating surface includes a fluid inlet port and a fluid outlet port, the fluid inlet port being spaced from the fluid outlet port; the driver includes a drive shaft and a drive plate carried by the distal end of the drive shaft, wherein the drive plate is inclined (i.e. angled) with respect to a plane normal to a longitudinal axis of the drive shaft such that the drive plate drives the conical body to precess about its apex in use such that at any given time the flexible membrane defines a contact portion in contact with the mating surface where the lateral surface of the conical body is adjacent to the mating surface, and defines a non-contact portion which is spaced from the mating surface; a pump chamber is defined by a cavity formed between the non-contact portion of the flexible membrane and the mating surface; the pump chamber rotates about an axis of the mating surface as the conical body precesses about its apex; and fluid is drawn into the pump chamber as it passes the fluid inlet port and the fluid is urged out of the pump chamber as it passes the fluid outlet port.

The terms "apex", "base" and "lateral surface" are understood to have their normal meaning in connection with conical bodies. Thus, the "base" is the circular portion defined by the part of the cone having the greatest diameter; the "apex" is the point of the cone; and the "lateral surface" is the curved surface which joins the base to the apex.

It should be further understood that the term "conical body" includes truncated conical bodies (i.e. frustoconical bodies). In the case of truncated conical bodies, the "apex" is considered to be the apex of the cone had it not been truncated (i.e. the nominal apex of a frustoconical body).

It will be appreciated that although the peripheral edge portion of the second face of the flexible membrane is secured to the mating surface, an inner portion of the second side is free and can be spaced from the mating surface to define a cavity (the pump chamber). The precession of the conical body about its apex forces the pump chamber to rotate about a circular path defined by the motion of the base of the conical body. As the flexible membrane is pulled away from the mating surface by the conical body, it generates a low pressure within the pump chamber, which draws fluid from the inlet port as it passes the inlet port. The fluid filled pump chamber is then pushed in a circular path by the precession of the conical body until it reaches the outlet port, at which time the fluid within the pump chamber is expelled from the chamber. In this way, one-way valves for the fluid inlet and the fluid outlet port are not required. In fact, the subject pump is able to act as a valve in the sense that it permits fluid flow from the inlet port to the outlet port which in operation and is able to prevent fluid flow when the pump is not in operation.

The use of a driver which has a drive shaft and an inclined drive plate means that lateral forces on the drive shaft (and thus, for example, the bearings of a motor) can be reduced or minimised, which in turn increases the operational life of the motor.

By attaching part of the first face of the flexible membrane to the conical body (e.g. by chemically bonding the membrane to the conical body and/or via the use of a mechanical attachment), the non-contact portion of the membrane is mechanically urged away from the mating surface. This in turn generates sufficient suction that the pump may be self-priming. Moreover, there is no friction between the conical body and the membrane which may cause wearing of the membrane. It is known that the pumping efficiency of pumps which rely upon the elastic nature of a membrane to define a pump chamber, such as peristaltic pumps and the pump disclosed in DE 1528971, decreases over time as the ability of the membrane to return to a non-stretched configuration decreases. However, as the membrane of the subject invention is mechanically drawn away from the mating surface, such problems are avoided. Similarly, pumps which rely upon the elastic nature of the membrane to define the pump chamber have a maximum speed at which they can pump, beyond which the membrane is unable to return to its rest configuration in time. The speed of the subject pump is limited only by the maximum operating speed of the driver, as the pump chamber is mechanically expanded and compressed by the precession of the conical body.

It will be understood that at any given time a contact portion exists where the flexible membrane contacts the mating surface. As the conical body precesses about its apex, the contact portion continuously moves in a circular path. It should be noted that the conical body may urge the flexible membrane into a sealing engagement with the mating surface.

The pump according to the invention is relatively quiet, but is able to generate relatively high pumping pressures. In addition, the partial vacuum generated by the pump chamber permits the pump to self-prime.

A yet further advantage of the pump according to the present invention is that it is reversible. It will be appreciated that if the precession of the cone about its apex is driven in the opposite sense, then the pump may draw fluid into the pump chamber from what is nominally the outlet port and may expel fluid from the pump chamber via what is nominally the inlet port. The absence of one-way valves associated with the inlet and outlet ports also make this reversible action possible.

The mating surface is suitably a planar surface.

In an embodiment of the invention, the fluid pump further includes a barrier located between the fluid inlet port and the fluid outlet port, wherein the barrier is adapted to provide a one-way flow from the fluid inlet port to the fluid outlet port (or vice versa in the case of the pump being operated in reverse). The barrier prevents fluid being drawn into the pump chamber from the outlet port and also prevents fluid being expelled into the inlet port.

The barrier may be resiliently deformable and may be formed from an elastomeric material. The barrier suitably extends between a portion of the mating surface and the second surface of the flexible membrane or it may be formed by urging a barrier portion of the flexible membrane into permanent and continuous contact with the mating surface. The barrier may be secured to the mating surface and the flexible membrane or it may form a part of the mating surface or the flexible membrane and is secured to the other of the flexible membrane and the mating surface. The barrier may be secured by welding, via an adhesive or by being clamped against the relevant surface.

In an embodiment of the invention, the barrier is a radial barrier and fluidly separates the fluid inlet port from the fluid outlet port. The radial barrier may be curved (i.e. it is radial in the sense that it extends from the centre of a circle to a point on the circumference of the circle) or it may be a linear barrier which extends along a radius of a circle defined by the precession of the conical body about its apex. Thus, the barrier may extend from the apex of the conical body to the base of the conical body when the conical body overlies the barrier.

In a yet further embodiment of the invention, the barrier is formed by a rigid tongue which engages a portion of the flexible membrane, wherein the tongue maintains the portion of the flexible membrane in sealing contact with the mating surface. In such an embodiment, the conical body may include a cut-out portion or a recess which is sized and shaped to receive therein the rigid tongue as the conical body precesses about its apex. The rigid tongue may be retained by or form part of a frame which surrounds the conical body and which is secured to a pump plate. The frame may secure the flexible body to the mating surface defined by the pump plate.

In embodiments in which the barrier is formed by a rigid tongue, the rigid tongue may be biased towards the membrane. Thus, for example, the rigid tongue may be formed from a metal or a polymeric material and it may have spring-like properties which urge the tongue towards the membrane and thereby preventing the membrane from being urged away from the mating surface in the gap defined between the inlet and outlet ports. This in turn results in a one-way flow from one port to the other port.

In embodiments in which the barrier is a linear barrier, the skilled person will appreciate that fluid flow may be possible through the pump if the conical body is not being driven and the contact portion is aligned with the barrier. Similarly, fluid flow may be prevented if the conical body is not being driven and the contact portion is out of alignment with the barrier. In this way, the pump is also able to operate as a valve. In such embodiments, the pump may include a controller which is adapted to control the orientation of the contact portion relative to the barrier when the conical body is not being driven (i.e. the pump is stationary or non-operational as a pump). The pump may further include a sensor to sense the orientation of the contact portion, for example relative to the barrier.

The flexible membrane may be resiliently deformable in the sense that it may be stretched upon the application of a force and will return to its normal or rest configuration upon the removal of the force. Thus, the resiliently deformable membrane may be a stretchable membrane. In such embodiments, the flexible membrane may be formed from an elastomeric material. In other words, the flexible membrane may comprise an elastomer. It may be desirable to weld the flexible membrane. In such cases, the flexible membrane may comprise a thermoplastic elastomer.

The mating surface may be a rigid surface. However, in certain embodiments, the mating surface may include a resiliently deformable material. In such embodiments, the engagement of the flexible membrane with the mating surface may define a nip between the two components, wherein the nip defines a fluid seal between the flexible membrane and the mating surface. The mating surface may be defined by an elastomeric material, which may be the same material from which the flexible membrane is formed.

In order that the pump chamber is suitably sealed by the conical body, the flexible membrane may be secured to the lateral surface of the conical body at a location which is a predetermined distance from the apex. Thus, the flexible membrane may be secured to the conical body between its apex and a circumference of the lateral surface located between the apex and the base. In this embodiment, the flexible membrane is not able to bulge outwards beyond the base of the conical body as pump chamber rotates (thereby reducing the available pump pressure). In embodiments in which the flexible membrane is secured to the conical body over an area between its apex and a circumference which is spaced from the base of the conical body, the conical body may be formed from two or more separate body portions. For example, the conical body may be formed from a first body portion, which defines the surface to which the flexible membrane is secured (i.e. from the apex to the circumferential line spaced from the base), and a second body portion which defines a frustoconical lateral surface which extends from the first body portion to the base of the conical body, wherein the flexible membrane is not secured to the second body portion. In other words, the conical body may be a two-part conical body, having a conical first part and a frustoconical second part, wherein the flexible membrane is secured only to the first part of the conical body.

In an embodiment of the invention, an external cone angle defined between the lateral surface of the conical body and a plane normal to the axis of the conical body is from 1° and 45°. It will be appreciated that an internal cone angle, namely the angle subtended between opposed sides of the lateral surface, in this embodiment will be from 90° to 178°, based on the mathematical relationship between the external cone angle (EC) and internal cone angle (IC): $IC+(2\times EC)=180$.

Suitably, the external cone angle is from 1° to 20°. Thus, the internal cone angle may be from 140° to 178°. In a further embodiment, the external cone angle is from 2° to 10°.

The driver of the invention may be an electric motor, such as, for example, a DC electric motor.

As noted above, the driver includes a drive shaft and a drive plate carried by the distal end of the drive shaft, wherein the drive plate is inclined with respect to a plane normal to a longitudinal axis of the drive shaft. Suitably, the drive plate rotates about an axis defined by the drive shaft of the driver. Thus, the drive shaft and the drive plate rotate about a common rotational axis.

In an embodiment, the driver is connected to or engages the base of the conical body and drives it to precess about its apex. Suitably, the angle of incline of the drive plate is substantially equal to the external cone angle.

In order to balance the motion of the conical body and to reduce or minimise vibration of the pump in use, the drive plate may be carried eccentrically by the distal end of the drive shaft. In this way, a portion of the drive plate extends radially beyond the base of the conical body and is able to balance the motion of the conical body. In embodiments in which the drive plate is formed from a metal, the eccentric nature of the drive plate may provide a sufficient balancing force. However, in embodiments in which the drive plate is formed from a polymeric material, the portion of the drive plate which extends beyond the base of the conical body may include a counterbalance, such as for example, an area of increased thickness.

In a further embodiment of the invention, the driver further includes a rotational coupling, for example a bearing, which may be located between the drive plate and the base of the conical body. In such an embodiment, the drive plate is capable of rotating relative to the conical body. The rotational coupling suitably includes a first coupling element which is capable of rotating relative to a second coupling element. Thus, the first coupling element may rotate with the drive plate and the second bearing surface may engage or be connected to the base of the conical body such that the rotation of the drive plate does not result in rotation of the conical body about its axis, but the rotation of the inclined drive plate relative to the conical body results in the precession of the conical body about its apex.

It will be appreciated that the fluid may be liquid, for example an aqueous liquid or an organic liquid. Thus, the pump may be a liquid pump. Alternatively, the fluid may be a gas.

The skilled person will appreciate that the features described and defined in connection with the aspects of the invention and the embodiments thereof may be combined in any combination, regardless of whether the specific combination is expressly mentioned herein. Thus, all such combinations are considered to have been made available to the skilled person.

An embodiment of the invention will now be described, by way of example only, with reference to the accompanying drawings in which:

FIG. 1 is an exploded perspective view of a fluid pump according to a first embodiment of the invention;

FIG. 2 is an exploded perspective view of the conical body shown in FIG. 1; and FIG. 3 is a side elevational view of the conical body, bearing and drive plate of the pump shown in FIG. 1.

For the avoidance of doubt, the skilled person will appreciate that in this specification, the terms "up", "down", "front", "rear", "upper", "lower", "width", etc. refer to the orientation of the components as found in the example when configured for normal use as shown in the Figures.

FIG. 1 shows a fluid pump 2 according to the invention. A pump plate formed from an end plate 4 and an end plate elastomeric layer 6, the end plate elastomeric layer 6 being adhered to the end plate 4 and defining the mating surface 8. The elastomeric layer is formed from a silicone polymer. The end plate 4 further defines a pair of apertures 10, 12 into which are secured by any suitable means an inlet port 14 and an outlet port 16. The end plate elastomeric layer 6 includes corresponding apertures 18, 20.

A conical body 22, 26 both defines a pump chamber and drives it between the inlet port 14 and the outlet port 16. This is described in more detail below. The conical body 22, 26 has an external cone angle of 2.5°. Thus, it has an internal cone angle of 175°. It will be appreciated that the cone angles may be selected according to the desired flow rate and pumping pressure of the pump. The conical body 22, 26 is formed as a two-part component, wherein the first part 22 of the conical body (from the apex to a point between the apex and the base) is formed from a relatively hard polymeric material, such as nylon, and a second part 26 of the conical body (a frustoconical section from the first part to the base of the conical body) is formed from aluminium. The conical body defines a boss 24 projecting axially rearwards. The aluminium outer ring 26 (the second part of the conical body) defines an aperture which locates the ring over an axially inner portion of the boss 24.

As shown in FIG. 2, the first part 22 of the conical body defines a radial slot 23 and the aluminium outer ring 26 defines a corresponding radial slot 27.

A flexible membrane 28 has a first face 29 with a first part 29*a* adhered to the first part 22 of the conical body 22, 26, and a second face 31 that is secured to the end plate elastomeric layer 6 around its peripheral edge. A second part 29*b* of the first face 29 of the flexible membrane 28 is not secured to the aluminium outer ring 26. The flexible membrane 28 is also formed from a silicone polymer and is secured to the end plate elastomeric layer 6 via a combination of an adhesive and a securing frame 30.

In an alternative embodiment, the flexible membrane may be attached to the conical body via a mechanical fixing, for example, the flexible membrane may be trapped between first and second portions of the conical body, or the flexible membrane may be attached to the conical body via a combination of a chemical adhesive and a mechanical bond, such as a portion of the flexible membrane being secured via a friction fit or interference fit within a corresponding channel defined by the conical body.

The securing frame 30 is formed from aluminium and defines a peripheral portion 32 which surrounds in use the aluminium outer ring 26 of the conical body and which sandwiches the peripheral edge portions of the end plate elastomeric layer 6 and the flexible membrane 28 between it and the end plate 4. The securing frame 30 further defines a tongue 34 which extends from one of the peripheral sides of the frame 30 towards its centre. The tongue 34 prevents a portion of the flexible membrane 28 located adjacent to it from displacement away from the end plate elastomeric layer 6. By clamping a portion of the flexible membrane 28 to the end plate elastomeric layer 6, a fluid seal between the membrane 28 and the elastomeric layer 6 is formed which provides a radial barrier. The radial barrier is located between the inlet port 14 and the outlet port 16.

The tongue is sized and shaped to fit within the radial slots 23, 27 formed in the first part 22 of the conical body and the outer ring 26 as the conical body precesses about its apex.

As can be seen in FIG. 3, the conical body 22, 26 is driven to precess about its apex by an inclined drive plate 36 formed from brass. The drive plate 36 is inclined with respect to plane "A" by 2.5° such that the conical body 22, 26 is arranged to have one side parallel to the end plate 4 and an opposite side which is inclined by 5° to the end plate 4.

The drive plate 36 includes a drive plate boss 38 which extends axially away from the conical body 22, 26. Located between the drive plate 36 and the outer ring 26 is a bearing 40 including two spaced plates separated by a plurality of ball bearings which allows the drive plate 36 to rotate relative to the outer ring 26 of the conical body 22, 26. The bearing 40 is located around the boss 24 of the conical body 22, 26.

In an alternative embodiment, the drive plate and bearing may be located within a cup-shaped element or the cup-shaped element may have an inclined or angled base which forms the inclined drive plate and the bearing may be located within the inclined cup-shaped element.

As can be seen from FIGS. 1 and 3, the drive plate boss 38 is located off-centre with respect to the rear of the drive plate 36, with centerline 39*a* of drive plate boss 38 being spaced from centerline 39*b* of drive plate 36. This results in an eccentric arrangement between the bearing 40 and the drive plate 36. This eccentric arrangement of the relatively heavy brass material has the effect of counterbalancing the motion of the conical body 22, 26.

A pump housing 42 is provided which houses the pump assembly components and to which the end plate 4 is secured via screws 44. A second bearing 46 is provided between the rear of the drive plate and the pump housing 42 such that the drive plate 36 is able to rotate relative to the pump housing 42. The second bearing 46 is located in position via the drive plate boss 38.

An electric motor 48, which is housed in a motor housing 50 is arranged to rotate the drive plate 36. The electric motor 48 includes a drive shaft 49 defining a longitudinal axis 3, which drive shaft 49 passes through a drive shaft aperture 52 defined by the pump housing 42 and is secured to the drive plate 36, as illustrated by the dashed longitudinal axis line 3.

In use, the electric motor drives the drive plate 36 to rotate. The rotation of the drive plate 36 is transferred via the bearing 40 to the conical body 22, 26. The rotation of the drive plate 36 via the bearing 40 results in the precession of the conical body 22, 26 about its apex. It will be noted that the conical body 22, 26 does not rotate. This will be understood by the fact that the tongue 34 enters and exits the radial slots 23, 27 on each complete rotation of the drive plate 36.

At any given time, a portion of the conical body 22, 26 is arranged to be parallel to the end plate 4 and urges a corresponding portion of the flexible membrane 28 into sealing engagement with the end plate elastomeric layer 6. At the same time, a second portion of the conical body 22, 26 is inclined away from the end plate 4 and this urges a corresponding portion of the flexible membrane 28 away from the end plate elastomeric layer 6. The gap between the spaced apart portions of the flexible membrane 28 and the end plate elastomeric layer 6 defines a cavity which forms a pump chamber. The pump chamber is closed on one hand by the barrier defined by the tongue urging the flexible membrane 28 into sealing engagement with the end plate elastomeric layer 6, and on the other hand by the portion of the conical body 22, 26 which also urges the flexible membrane 28 into sealing engagement with the end plate elastomeric layer 6. The precession of the conical body 22, 26 causes the pump chamber to rotate about an axis defined by the apex of the conical body 22, 26. As the chamber passes the inlet port 14, the action of the flexible membrane 28 being urged away from the end plate elastomeric layer 6 generates a partial vacuum within the pump chamber and this draws fluid into the chamber from the inlet port 14. The barrier prevents fluid being drawn from the outlet port 16. The precession of the conical body 22, 26 pushes the pump chamber around its circular path until it reaches the outlet port. As the contact portion of the conical body 22, 26 approaches the barrier, the pressure within the chamber increases and the fluid held within the chamber is expelled through the outlet port 16. The cycle is then repeated.

The invention claimed is:

1. A fluid pump comprising a conical body having an apex and a base, wherein the conical body further defines a lateral surface between the apex and base; a mating surface defined by a pump plate; a flexible membrane having a first face comprising a first part which is attached to at least a portion of the lateral surface of the conical body and a second part which is free, and having a second, opposite face secured around its periphery to the mating surface; and a driver adapted to drive the conical body; wherein the mating surface includes a fluid inlet port and a fluid outlet port, the fluid inlet port being spaced from the fluid outlet port; the driver includes a drive shaft that is rotatable about a longitudinal axis, a drive plate carried eccentrically by a distal end of the drive shaft, and a rotational coupling comprising a first coupling element and a second coupling element, with the first coupling element being rotatable relative to the second coupling element, wherein the drive plate includes a first planar surface which is parallel to a plane normal to the longitudinal axis of the drive shaft and an opposed second planar surface which is inclined with respect to the plane normal to the longitudinal axis of the drive shaft, wherein the first planar surface has projecting from it a boss which is eccentrically carried by the first planar surface and wherein the boss connects the drive plate to the drive shaft, and the opposed second planar surface faces the conical body, the first coupling element of the rotational coupling being in contact with the opposed second planar surface of the drive plate and the second coupling element of the rotational coupling being in contact with the base of the conical body, whereby the drive plate rotates relative to the base of the conical body and the driver drives the conical body to precess about its apex in use such that at any given time the flexible membrane defines a contact portion in contact with the mating surface where the lateral surface of the conical body is adjacent to the mating surface, and defines a non-contact portion which is spaced from the mating surface; a pump chamber is defined by a cavity formed between the non-contact portion of the flexible membrane and the mating surface; the pump chamber rotates about an axis of the mating surface as the conical body precesses about its apex; and fluid is drawn into the pump chamber as it passes the fluid inlet port and the fluid is urged out of the pump chamber as it passes the fluid outlet port.

2. A fluid pump according to claim 1, wherein the pump further includes a barrier located between the fluid inlet port and the fluid outlet port, wherein the barrier is adapted to provide a one-way flow from the fluid inlet port to the fluid outlet port.

3. A fluid pump according to claim 2, wherein the barrier is a radial barrier and fluidly separates the fluid inlet port from the fluid outlet port along a radius of a circle defined by the precession of the conical body about its apex.

4. A fluid pump according to claim 1, wherein the flexible membrane is an elastomer.

5. A fluid pump according to claim 4, wherein the flexible membrane is a thermoplastic elastomer.

6. A fluid pump according to claim 1, wherein the mating surface is substantially planar.

7. A fluid pump according to claim 1, wherein the mating surface comprises a resiliently deformable material.

8. A fluid pump according to claim 7, wherein the resiliently deformable material is an elastomer.

9. A fluid pump according to claim 8, wherein the mating surface and the flexible membrane are independently formed from the same elastomeric material.

10. A fluid pump according to claim 1, wherein an external cone angle defined between the lateral surface of the conical body and a plane normal to the axis of the conical body is from 1° to 45°.

11. A fluid pump according to claim 10, wherein the external cone angle is from 1° to 20°.

12. A fluid pump according to claim 1, wherein the driver includes an electric motor.

13. A fluid pump according to claim 1, wherein the an angle of incline of the opposed second planar surface of the drive plate is substantially equal to an external cone angle defined between the lateral surface of the conical body and a plane normal to the axis of the conical body.

* * * * *